US008910704B2

(12) United States Patent
Mizuno et al.

(10) Patent No.: US 8,910,704 B2
(45) Date of Patent: Dec. 16, 2014

(54) HEAT EXCHANGER

(75) Inventors: Yasuhiro Mizuno, Chiryu (JP); Ryutaro Nozaki, Nukata-gun (JP); Hiroshi Yamasaki, Anjo (JP); Hirotaka Ishikawa, Okazaki (JP); Ryuji Shirakawa, Nishio (JP); Shuhei Yamazaki, Nishio (JP); Syunji Itou, Kariya (JP)

(73) Assignee: Denso Corporation, Kariya (JP)

( * ) Notice: Subject to any disclaimer, the term of this patent is extended or adjusted under 35 U.S.C. 154(b) by 498 days.

(21) Appl. No.: 13/432,156

(22) Filed: Mar. 28, 2012

(65) Prior Publication Data

US 2012/0247742 A1 Oct. 4, 2012

(30) Foreign Application Priority Data

Apr. 1, 2011 (JP) ..... 2011-082087

(51) Int. Cl.

| | |
|---|---|
| ***F28D 7/16*** | (2006.01) |
| ***F28F 9/02*** | (2006.01) |
| ***F28D 1/053*** | (2006.01) |
| ***F28D 1/04*** | (2006.01) |
| *F28D 21/00* | (2006.01) |

(52) U.S. Cl.

CPC ..... *F28D 1/05391* (2013.01); *F28F 9/0209* (2013.01); *F28F 9/0226* (2013.01); *F28D 1/0443* (2013.01); *F28D 2021/0094* (2013.01)

USPC ..... 165/174; 165/135; 165/140; 165/173

(58) Field of Classification Search

CPC ..... F28D 1/0443; F28F 9/0209; F28F 9/0226

USPC ..... 165/173–176, 135, 140

See application file for complete search history.

(56) References Cited

U.S. PATENT DOCUMENTS

| | | | | |
|---|---|---|---|---|
| 4,485,867 | A * | 12/1984 | Melnyk et al. | 165/173 |
| 7,779,893 | B2 * | 8/2010 | Leitch et al. | 165/173 |
| 2002/0040776 | A1 | 4/2002 | Kokubunji et al. | |
| 2007/0277956 | A1 | 12/2007 | Bergmiller et al. | |
| 2011/0168372 | A1 | 7/2011 | Takahashi et al. | |

FOREIGN PATENT DOCUMENTS

| | | |
|---|---|---|
| DE | 4232376 | 3/1994 |
| FR | 2712674 | 5/1995 |
| FR | 2785376 | 5/2000 |
| JP | 2003-336994 | 11/2003 |
| WO | WO 2010/133491 | 11/2010 |

OTHER PUBLICATIONS

Office action dated Nov. 18, 2013 in corresponding Chinese Application No. 201210090789.5.

* cited by examiner

*Primary Examiner* — Leonard R Leo

(74) *Attorney, Agent, or Firm* — Harness, Dickey & Pierce, PLC

(57) ABSTRACT

An outer peripheral sealing surface of an inner surface of a core plate of a header tank is configured into a loop and extends along an outer peripheral edge portion of the core plate and clamps a packing in cooperation with an outer peripheral end portion of a tank main body of the header tank. A transition section of the outer peripheral sealing surface connects between a primary section and a secondary section, which are located in two different planes, respectively, and the plane of the secondary section is the same as a plane of a boundary portion sealing surface held between two tube connecting surfaces in the core plate.

5 Claims, 9 Drawing Sheets

HEAT EXCHANGER

CROSS REFERENCE TO RELATED APPLICATION

This application is based on and incorporates herein by reference Japanese Patent Application No. 2011-82087 filed on Apr. 1, 2011.

TECHNICAL FIELD

The present disclosure relates to a heat exchanger.

BACKGROUND

For instance, WO 2010/133491A1 teaches a header tank (collector box) of a heat exchanger that has two inside spaces, which are partitioned by a partition wall for two heat exchange systems.

The header tank of the heat exchanger of WO 2010/133491A1 includes a core plate (collector plate), a cover and a seal. The core plate has a bottom, which has tube receiving holes and is surrounded by a peripheral groove. The cover has a peripheral lug. The seal is held between the peripheral groove of the core plate and the peripheral lug of the cover and is also held between the core plate and the partition wall of the cover. Furthermore, a portion of the bottom of the core plate, which is opposed to the partition wall, is locally recessed in a view taken from an inside of the header tank, so that the sealing surface of the seal extends in a plane.

In the header tank of WO 2010/133491A1, the sealing surface of the seal extends in the plate, so that a uniform compression force may be achieved along the entire sealing surface of the seal. However, since the portion of the core plate is locally recessed in the view taken from the inside of the header tank, a projecting length of an end portion of the tube, which projects from the recessed portion of the core plate into the inside of the header tank, becomes longer than that of the other tube, which projects from another portion of the core plate that is other than the recessed portion. This construction poses the following disadvantage with respect to the production of the header tank.

Normally, the tubes are fixed to the core plate as follows. That is, each of the tubes is inserted into the corresponding tube receiving hole of the core plate. Then, a dedicated tool is inserted into an opening of an end portion of the tube to widen the opening of the end portion of the tube from the inside of the tube and thereby to plastically deform a connecting portion of the tube, which is connected to the peripheral edge of the receiving hole. In this way, the tube is temporarily fixed to the tube receiving hole. Thereafter, the tube is brazed to the core plate. Therefore, in the case of WO 2010/133491A1, the amount of deformation of the end portion of the tube, which has the long projecting length discussed above, needs to be increased to plastically deform the connecting portion of the tube, which is connected to the receiving hole of the core plate, by a predetermined amount. This might possibly cause cracking of the end portion of the tube. Alternatively, the amount of plastic deformation of the tube at the connecting portion received in the receiving hole might possibly become insufficient. In such a case, a clearance at a brazing part between the tube and the receiving hole might become excessively large to cause a brazing defect. Furthermore, when the tubes are excessively deformed to have an increased width at the end portion of the tube, a size of a space between the end portions of the adjacent two tubes may be reduced. Thereby, a partition plate may be snagged, i.e., caught between the tubes without being held in place at the time of assembling of a tank main body of the header tank, thereby resulting in deterioration of the assembling efficiency. Furthermore, in the header tank of WO 2010/133491A1, the core plate is locally recessed in the view taken from the inside of the header tank, so that a heat exchanging surface area between the tube, which is connected to the locally recessed portion of the core plate, and the air may be reduced at the outside of the header tank in comparison to the other tubes, which are placed at the outside of the locally recessed portion at the core plate.

SUMMARY

The present disclosure is made in view of the above disadvantages. Thus, it is an objective of the present disclosure to provide a head exchanger that addresses at least one of the above disadvantages. According to the present disclosure, there is provided a heat exchanger, which includes a core and two header tanks. The core includes a plurality of tubes, which are configured to conduct fluid. The two header tanks are placed at two opposed longitudinal ends, respectively, of the plurality of tubes and are communicated with the plurality of tubes. Each of the two header tanks includes a core plate, a tank main body, at least one partition wall, at least two tank chambers and a seal member. The plurality of tubes is joined to the core plate. The at least one partition wall is joined to the tank main body. The at least two tank chambers are formed by the core plate, the tank main body and the at least one partition wall. An inner surface of the core plate includes an outer peripheral sealing surface, at least two tube connecting surfaces and at least one boundary portion sealing surface. The outer peripheral sealing surface is configured into a loop and extends along an outer peripheral edge portion of the core plate and clamps the seal member in cooperation with an outer peripheral end portion of the tank main body. The at least two tube connecting surfaces extend in a corresponding plane and are located on an inner side of the outer peripheral sealing surface where the plurality of tubes is located. Each of the at least two tube connecting surfaces has at least one tube receiving hole, through each of which a corresponding one of the plurality of tubes is received. The at least one boundary portion sealing surface extends in a corresponding plane. Each of the at least one boundary portion sealing surface is located between corresponding adjacent two of the at least two tube connecting surfaces to clamp the seal member in corporation with an end of each corresponding one of the at least one partition wall. The outer peripheral sealing surface includes at least one primary section, at least one secondary section and at least one transition section. The at least one primary section extends in a corresponding plane. The at least one secondary section extends in a corresponding plane. The corresponding plane of the at least one secondary section is generally parallel to the corresponding plane of the at least one primary section and is spaced from the corresponding plane of the at least one primary section in a direction perpendicular to the corresponding plane of the at least one primary section. Each of the at least one transition section connects between a corresponding one of the at least one primary section and a corresponding one of the at least one secondary section and is tilted relative to the corresponding plane of the at least one primary section and the corresponding plane of the at least one secondary section. The corresponding plane of the at least one primary section is generally parallel to the corresponding plane of the at least two tube connecting surfaces and is placed on a side of the corresponding plane of the at least two tube connecting surfaces where an outside of the header tank is located. The corresponding plane of the at least one boundary portion sealing surface is displaced from the corresponding plane of the at least one primary section in a direction perpendicular to the corresponding plane of the at least one primary section within a range that does not exceed the corresponding plane of the at least two tube connecting surfaces on a side where an inside of the header tank is located. The corresponding plane of the at least one secondary section is the same as the corresponding plane of the at least one boundary portion sealing surface.

BRIEF DESCRIPTION OF THE DRAWINGS

The drawings described herein are for illustration purposes only and are not intended to limit the scope of the present disclosure in any way.

DETAILED DESCRIPTION

Figure 1:
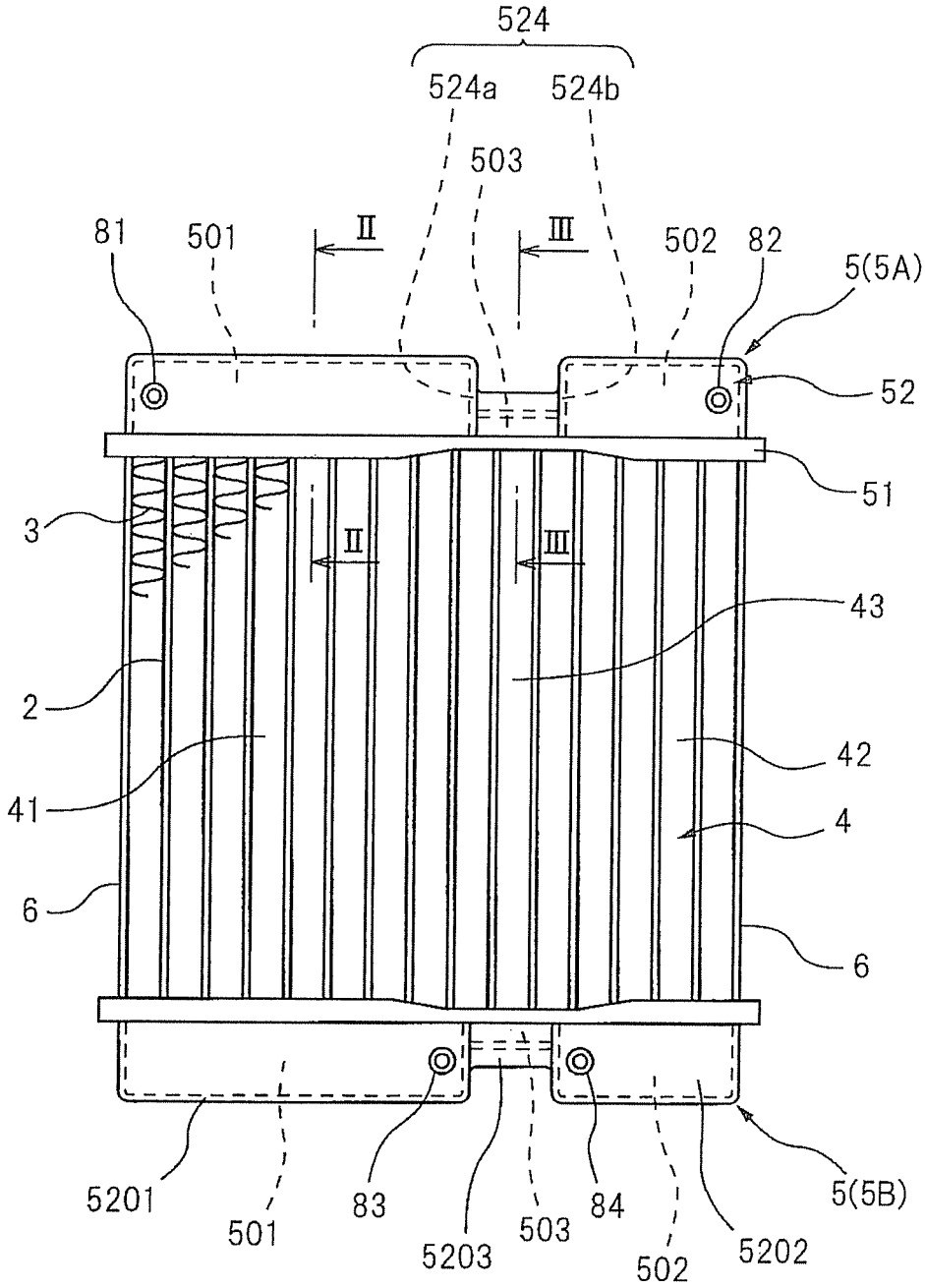
FIG. 1 is a front view of the heat exchanger according to a first embodiment of the present disclosure.

Various embodiments of the present disclosure will be described with reference to the accompanying drawings. In each of the following embodiments, similar components are indicated by the same reference numerals.

First Embodiment

A first embodiment of the present disclosure will be described with reference to FIGS. 1 to 7. In the present embodiment, a heat exchanger of the present disclosure is implemented as a heat exchanger of a hybrid vehicle, in which a drive force of the vehicle is obtained from an internal combustion engine and a drive electric motor.

FIG. 1 is a front view of the heat exchanger according to the first embodiment. As shown in FIG. 1, the heat exchanger of the present embodiment includes a core 4 and two header tanks 5. The core 4 has a plurality of tubes 2 and a plurality of fins 3. The tubes 2 are arranged one after another, i.e., are stacked one after another at generally equal intervals in a stacking direction thereof (a left-to-right direction in FIG. 1). The header tanks 5 are installed to an upper end portion and a lower end portion, respectively, of the core 4.

Each tube 2 is formed as a flat tube, which is configured to conduct fluid therethrough and has an elongated cross-section, in which an elongating direction of the cross-section of the tube coincides with a flow direction (also referred to as an air flow direction) of air that flows around the flat tube through the core 4. A longitudinal direction of the tube 2 coincides with a top-to-bottom direction of FIG. 1. Each fin 3 is configured into a wavy form and is joined to planar outer surfaces of adjacent two of the tubes 2. The fin 3 increases a heat conducting surface area of the core 4 to promote heat exchange between the fluid, which flows through the tubes 2, and the air.

Figure 7:
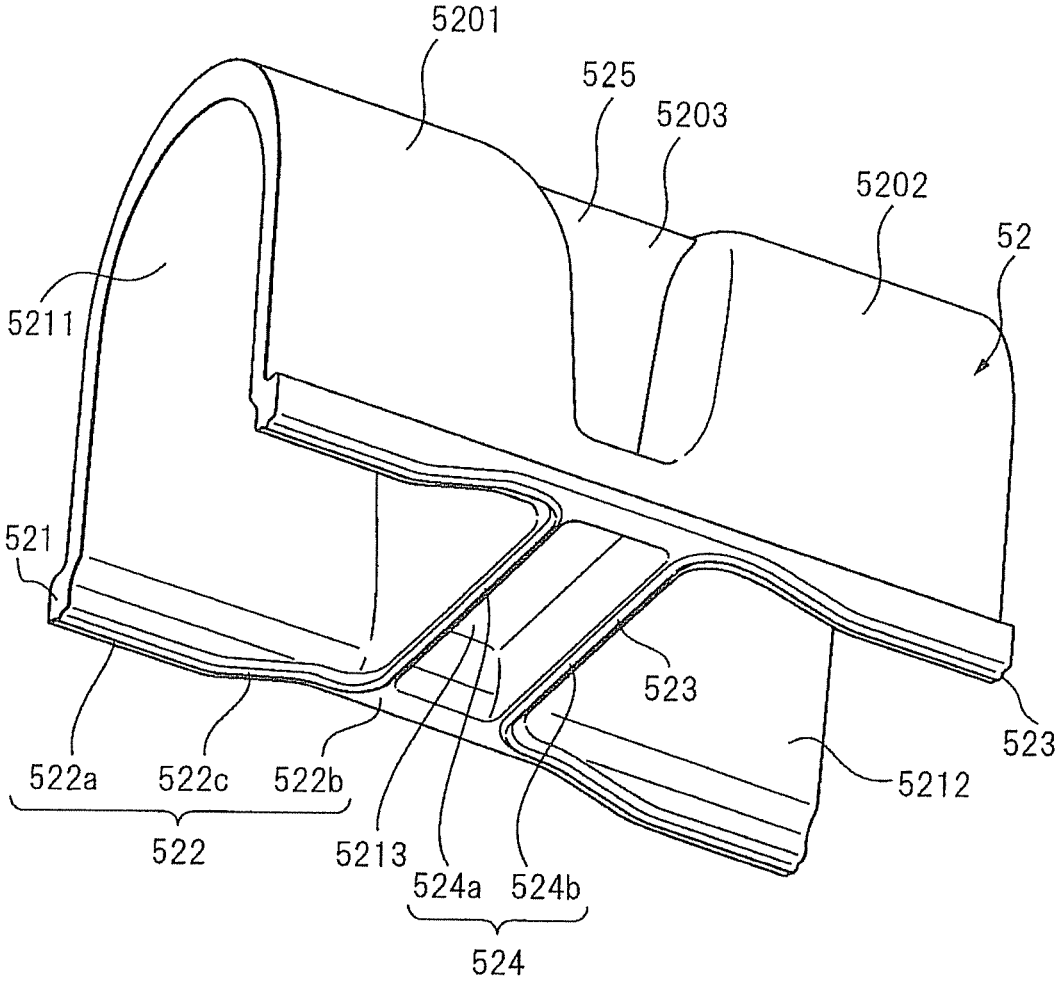
FIG. 7 is a partial enlarged perspective view showing a main feature of a tank main body of the header tank of the heat exchanger of the first embodiment.

The header tanks 5 are respectively arranged at the upper and lower ends (two opposed longitudinal ends) of the tubes 2. Each header tank 5 is elongated in a horizontal direction (left-to-right direction) of FIG. 1 and has first and second tank chambers 501, 502 that are communicated with the tubes 2. The header tank 5 includes a core plate 51, a tank main body 52 and partition walls 524. The tubes 2 are received by and are joined to the core plate 51. The partition walls 524 include a first partition wall 524*a* and a second partition wall 524*b*, which are joined to the tank main body 52, more specifically are formed integrally with the tank main body 52. Furthermore, the header tank 5 includes a packing 53 (not shown in FIG. 1), which is a seal member that is made of rubber and seals between the core plate 51 and the tank main body 52 having the partition walls 524. Furthermore, as shown in FIG. 7, which is an enlarged perspective view showing a main feature of the tank main body 52, the tank main body 52 includes a first recess 5211 and a second recess 5212, which are arranged one after another in the stacking direction of the tubes 2, and an intermediate recess 5213 is held between the first recess 5211 and the second recess 5212 in the stacking direction of the tubes 2 in the tank main body 52. The first recess 5211, the second recess 5212 and the intermediate recess 5213 are closed with the core plate 51 to form the first tank chamber 501, the second tank chamber 502 and an intermediate chamber 503, respectively. In other words, the first and second chambers 501, 502 and the intermediate chamber 503 are formed by the core plate 51, the outer wall of tank main body 52 and the first and second partition walls 524.

One of the header tanks 5, which is placed at the upper side, is referred to as an upper header tank (also referred to as a first header tank) 5A, and the other one of the header tanks 5, which is placed at the lower side, is referred to as a lower header tank (also referred to as a second header tank) 5B. An engine coolant inlet 81 and an electric system coolant inlet 82 are formed in the upper header tank 5A. The engine coolant inlet 81 is communicated with the first tank chamber 501 of the upper header tank 5A to supply engine coolant into the first tank chamber 501. The electric system coolant inlet 82 is communicated with the second tank chamber 502 of the upper header tank 5A to supply electric system coolant into the second tank chamber 502. An engine coolant outlet 83 and an electric system coolant outlet 84 are formed in the lower header tank 5B. The engine coolant outlet 83 is communicated with the first tank chamber 501 of the lower header tank 5B to output the engine coolant from the first tank chamber 501. The electric system coolant outlet 84 is communicated with the second tank chamber 502 of the lower header tank 5B to output the electric system coolant from the second tank chamber 502. A fluid inlet or outlet for fluid, such as the coolant, is not provided to any of the intermediate chambers 503 of the upper and lower header tanks 5A, 5B, and an inside of each intermediate chamber 503 is filled with air.

Although the upper header tank 5A and the lower header tank 5B differ with respect to the inflow and the outflow of the coolants as discussed above, a basic structure of the upper header tank 5A and a basic structure of the lower header tank 5B are the same. Therefore, in the present specification, the upper header tank 5A will be described as the header tank 5 at the time of describing the structure of the header tank 5 in the following description.

Two side plates 6 are provided at the two lateral sides, respectively, of the core 4, which are opposed to each other in the stacking direction of the tubes 2, to reinforce the core 4. Each side plate 6 is elongated in the longitudinal direction (tube longitudinal direction) of the tubes 2, and two opposed end portions of the side plate 6 are connected to, i.e., joined to the header tanks 5.

The core 4 includes a first radiator arrangement 41, a second radiator arrangement 42 and a thermally insulating arrangement 43. The first radiator arrangement 41 includes the corresponding tubes 2, which are connected to the first tank chambers 501 of the upper and lower header tanks 5A, 5B. The second radiator arrangement 42 includes the corresponding tubes 2, which are connected to the second tank chambers 502 of the upper and lower header tanks 5A, 5B. The thermally insulating arrangement 43 includes two of the tubes 2, which are connected to the intermediate chambers 503 of the upper and lower header tanks 5. The two tubes 2 of the thermally insulating arrangement 43 are connected to the intermediate chamber 503 of the upper and lower header tanks 5A, 5B and do not conduct fluid such as the coolant. That is, the fluid does not flow through these two tubes 2. In the present embodiment, the thermally insulating arrangement 43 includes the two tubes 2. However, the number of tubes 2 of the thermally insulating arrangement 43 is not limited to this number and may be changed to one or three or more.

In the present embodiment, the first radiator arrangement 41 exchanges heat between the engine coolant, which is circulated through the engine (not shown), and the air to cool the engine coolant. Furthermore, the second radiator arrangement 42 exchanges heat between the electric system coolant, which is circulated through the electric motor (not shown) and an electric control circuit (e.g., an inverter circuit) that controls the electric motor, and the air to cool the electric system coolant that cools the electric motor and the electric control circuit. The first radiator arrangement 41 and the second radiator arrangement 42 correspond to a plurality of heat exchanging arrangements (first and second heat exchanging arrangements) of the present disclosure.

Figure 2:
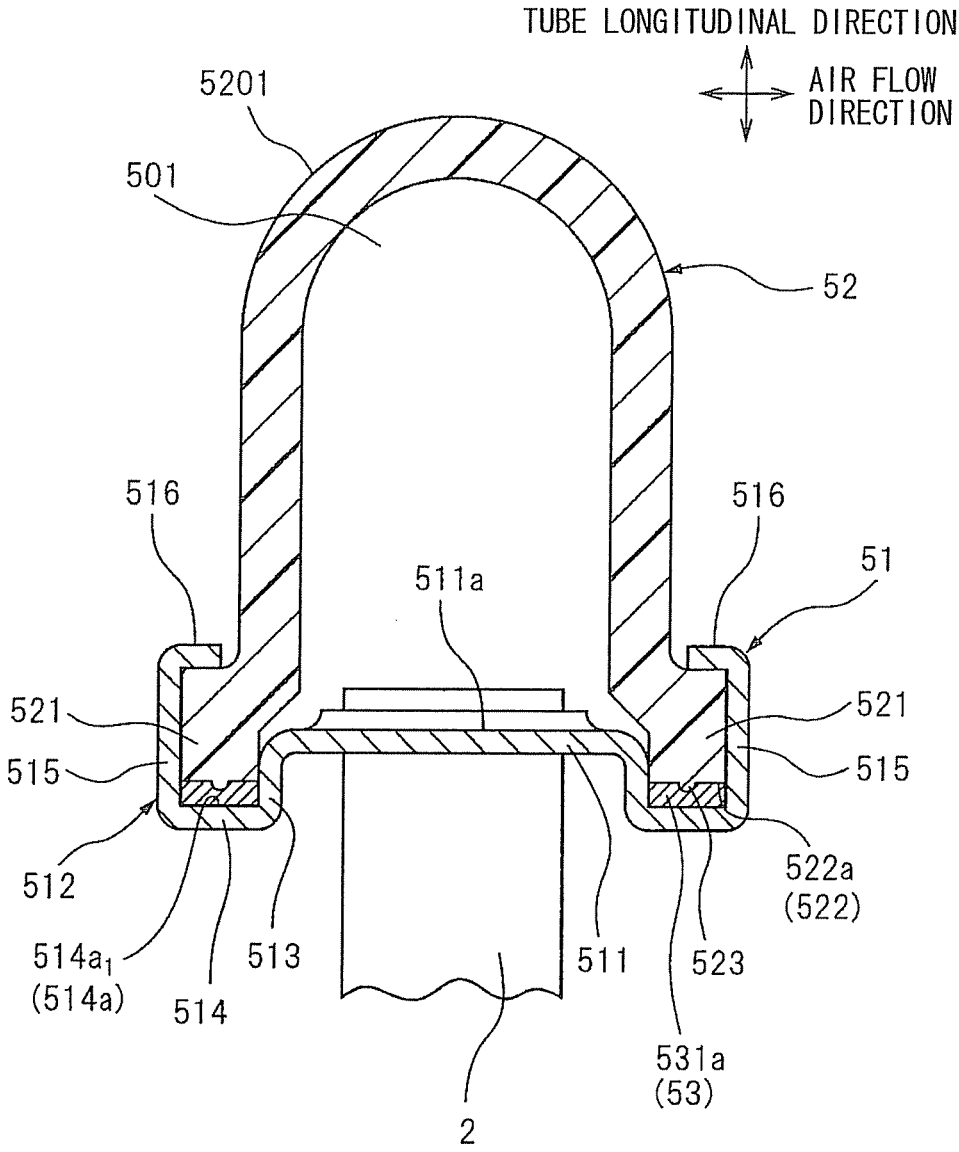
FIG. 2 is an enlarged cross-sectional view taken along line II-II in FIG. 1.
Figure 3:
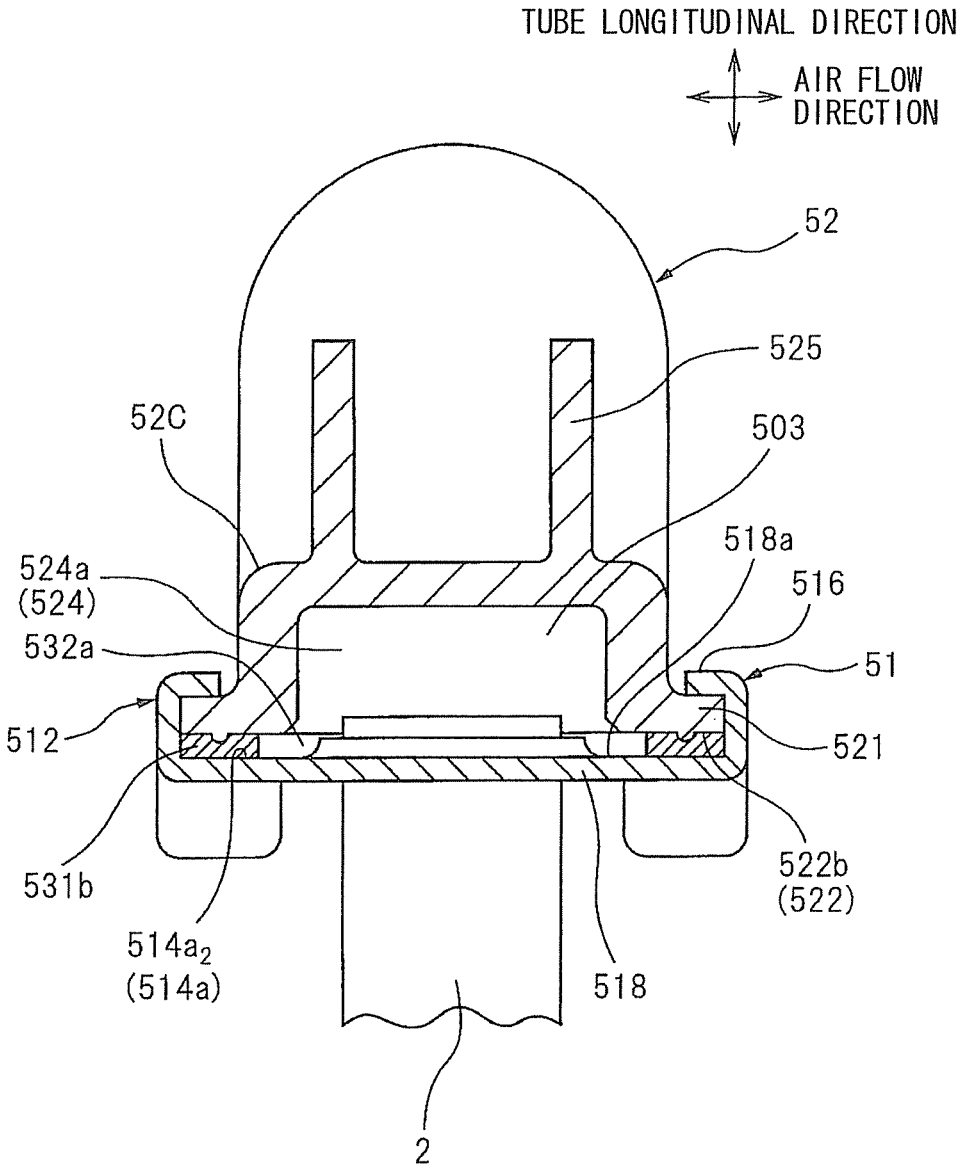
FIG. 3 is an enlarged cross-sectional view taken along line III-III in FIG. 1.
Figure 4:
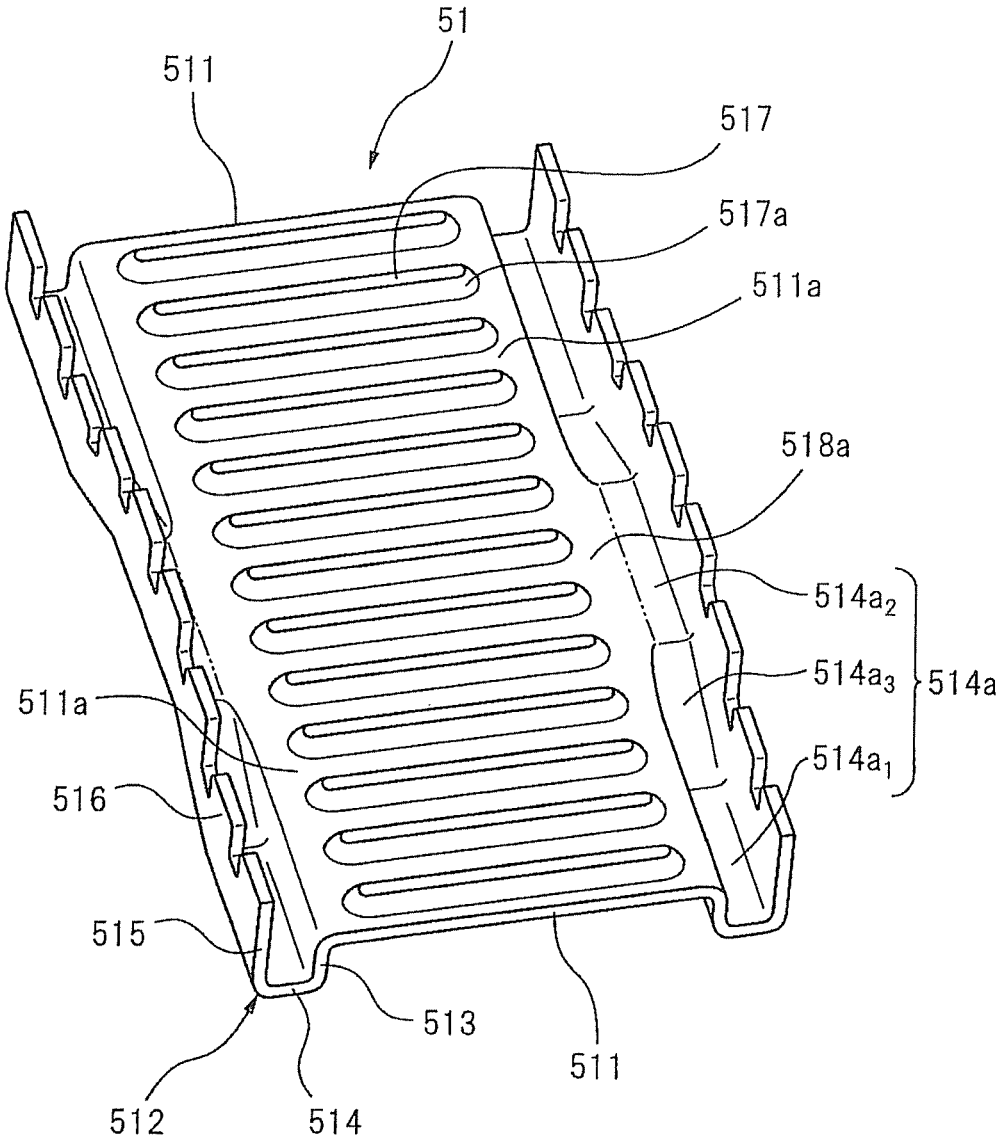
FIG. 4 is a partial enlarged perspective view showing a main feature of a core plate of a header tank of the heat exchanger of the first embodiment.
Figure 5:
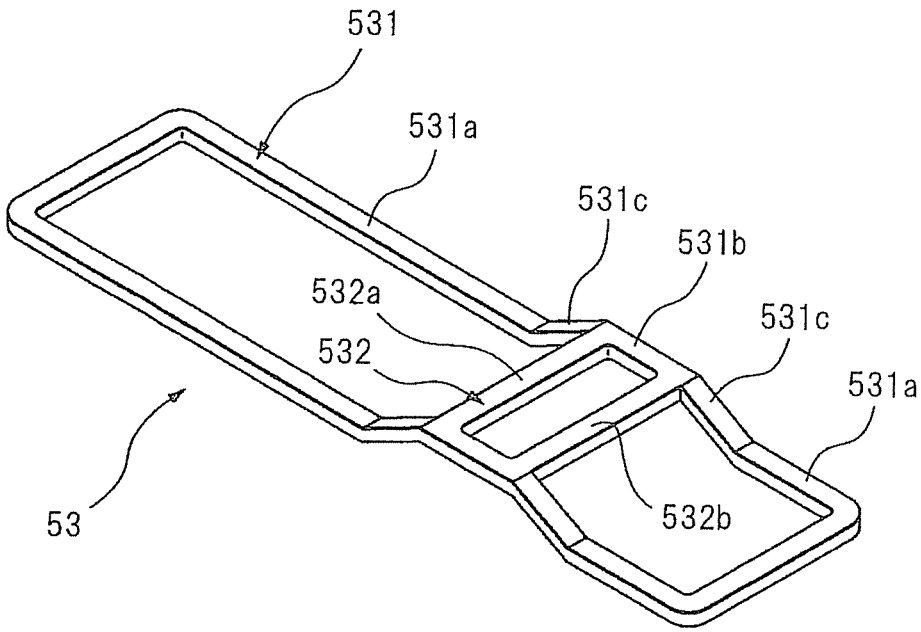
FIG. 5 is a perspective view of a packing of the header tank of the heat exchanger of the first embodiment.
Figure 6:
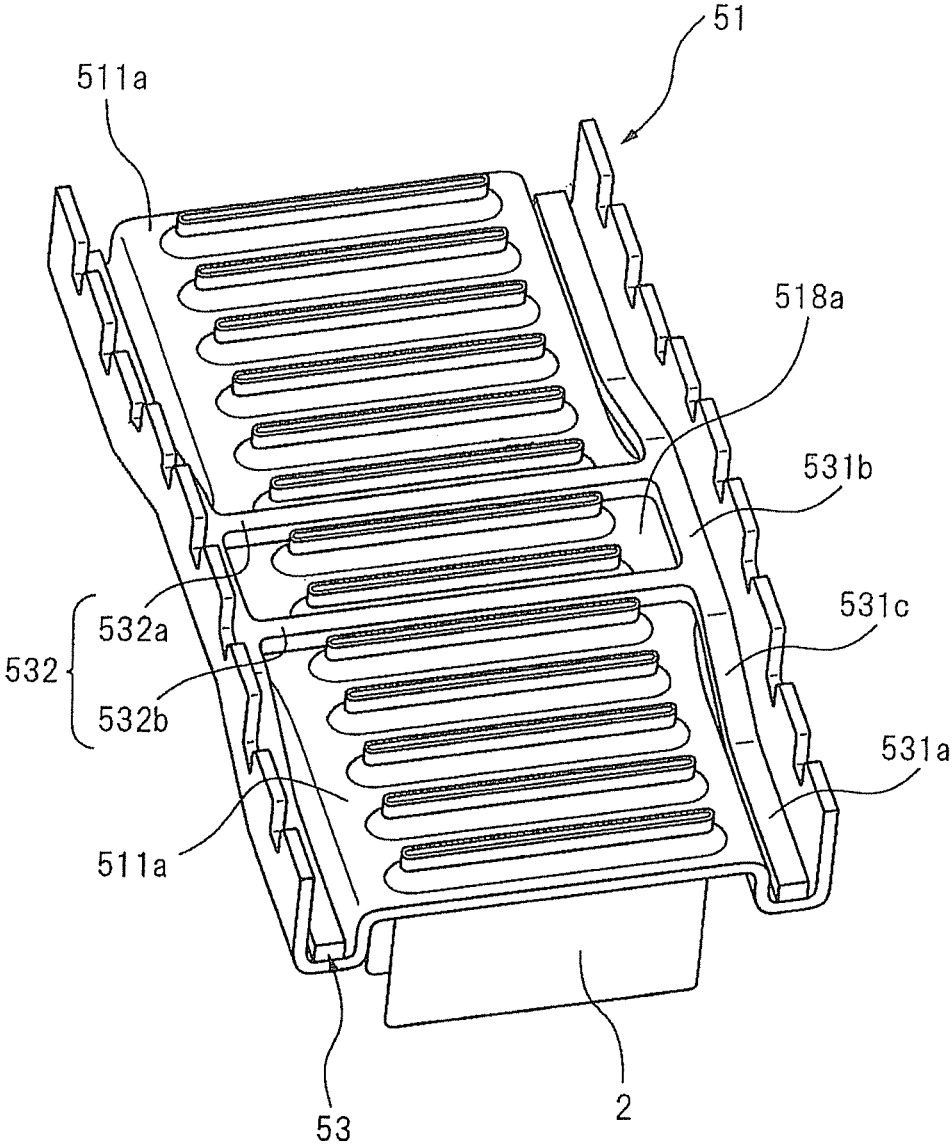
FIG. 6 is a partial enlarged perspective view showing the main feature of the core plate, to which the packing and tubes are installed according to the first embodiment.

Next, the structure of the header tank 5 will be described in detail. FIG. 2 is an enlarged cross-sectional view taken along line II-II in FIG. 1, showing a cross-section of the first tank chamber 501 of the header tank 5. FIG. 3 is an enlarged cross-sectional view taken along line III-III in FIG. 1, showing a cross-section of the intermediate chamber 503 of the header tank 5. FIG. 4 is a partial enlarged perspective view showing a main feature of the core plate 51 of the header tank 5. FIG. 5 is a perspective view of the packing 53 of the header tank 5. FIG. 6 is a partial enlarged perspective view showing the main feature of the core plate 51, to which the packing 53 and the tubes 2 are installed. FIG. 7 is a partial enlarged perspective view showing a main feature of the tank main body 52 of the header tank 5.

In the present embodiment, the core plate 51 of the header tank 5 is made of an aluminum alloy, and the tank main body 52 of the header tank 5 is made of glass fiber reinforced polyamide resin. As shown in FIGS. 2 and 3, in a state where the packing 53 made of the rubber is held between the core plate 51 and the tank main body 52 as well as between the core plate 51 and the partition walls 524, projections 516 of the core plate 51, which will be described later, are bent against the tank main body 52 by swaging to fix the tank main body 52 to the core plate 51.

The core plate 51 is configured into a generally rectangular planar form and includes a groove 512, two tube connecting portions 511 and a boundary portion 518. The groove 512 is configured into a loop and extends along an outer peripheral edge portion of the core plate 51. The two tube connecting portions 511 are placed at two locations, which correspond to the first tank chamber 501 and the second tank chamber 502, respectively, and tube receiving holes 517 are formed in each of the tube connecting portions 511. The boundary portion 518 is held between the tube connecting portions 511 and is placed at a location, which corresponds to the intermediate chamber 503. A flange portion 521, which is formed at an end portion of the tank main body 52, as well as the packing 53 are inserted into the groove 512. The flange portion 521 of the tank main body 52 forms an outer peripheral end portion of the present disclosure.

The groove 512 of the core plate 51 includes three portions. Specifically, the groove 512 includes an inner wall portion (also referred to as an inner vertical wall portion) 513, an outer peripheral portion 514 and an outer wall portion (also referred to as an outer vertical wall portion) 515. The inner wall portion 513 is bent generally at a right angle from outer peripheral edges of the tube connecting portions 511 and extends downward in FIG. 2. The outer peripheral portion 514 extends from a lower end of the inner wall portion 513 in a horizontal direction in FIG. 2. The outer wall portion 515 is bent generally at a right angle from an outer peripheral edge of the outer peripheral portion 514 and extends upward in FIG. 2. The projections 516, each of which is configured into a generally rectangular form, are arranged at generally equal intervals along an upper end of the outer wall portion 515. The projections 516 initially extend in the same direction as that of the outer wall portion 515 and are inwardly bent generally in the horizontal direction to urge the flange portion 521 against the packing 53 upon placement of the flange portion 521 of the tank main body 52 in the groove 512.

With reference to FIGS. 2 and 4, a majority of an outer peripheral sealing surface 514*a*, which is an inner surface (upper surface in FIGS. 2 and 4) of the outer peripheral portion 514 of the groove 512, is located in an corresponding plane that is placed on a side (lower side in FIGS. 2 and 4) of tube connecting surfaces 511*a*, which are inner surfaces of the tube connecting portions 511, where an outside of the header tank 5 is located. The outer peripheral sealing surface 514*a* is configured into a loop and extends along the outer peripheral edge portion of the core plate 51 and clamps the packing 53 in cooperation with the flange portion 521 of the tank main body 52. In this specification, this majority of the outer peripheral sealing surface 514*a* includes two primary sections 514*a*1. With reference to FIGS. 3 and 4, two portions of the outer peripheral sealing surface 514*a*, which are adjacent to a boundary portion sealing surface 518*a* that is an inner surface of the boundary portion 518, extend in a corresponding plane, in which the boundary portion sealing surface 518*a* is located. In the present specification, these two portions of the outer peripheral sealing surface 514*a*, which are adjacent to the boundary portion sealing surface 518*a*, are referred to as secondary sections 514*a*2. A boundary between each secondary section 514*a*2 and the boundary portion sealing surface 518*a* is indicated by a dot-dot-dash line in FIG. 4 for ease of understanding.

The inner wall portion 513 is absent in the groove 512 at the locations where the secondary sections 514*a*2 are respectively formed. Furthermore, the outer peripheral sealing surface 514*a* further includes four transaction sections 514*a*3, each of which connects between the corresponding adjacent primary section 514*a* and the corresponding adjacent secondary section 514*a*2. Therefore, when the core plate 51 is viewed in FIG. 1, the core plate 51 has a trapezoidal recess.

With reference to FIG. 4, the two tube connecting surfaces 511*a*, which are placed on the one side and the other side, respectively, of the boundary portion sealing surface 518*a* in the stacking direction of the tubes 2, extend in the corresponding common plane (the same plane) on the inner side of the outer peripheral sealing surface 514*a* where the tubes 2 are located. In this embodiment, the plane of the boundary portion sealing surface 518*a* is the same as the plane of the tube connecting surfaces 511*a*, that is, the boundary portion sealing surface 518*a* and the tube connecting surfaces 511*a* extend in the common plane. Furthermore, the tube receiving holes 517, in each of which the corresponding tube 2 is received, fixed by swaging and brazed, are arranged one after another in the stacking direction of the tubes 2 in each tube connecting surface 511*a*. A peripheral protrusion 517*a* is formed to protrude upwardly in FIG. 4 around each tube receiving hole 517 through a burring process to reliably perform the fixation of the tube 2 by the swaging and the brazing of the tube 2 relative to the tube receiving hole 517. Furthermore, two side plate receiving holes (not shown), into which the side plates 6 are respectively received and brazed, are formed at two outer end portions of the tube connecting surfaces 511*a*, which are opposed to each other in the stacking direction of the tubes 2. Furthermore, the two tube receiving holes 517, into which the two tubes 2 (the tubes 2 not conducting the fluid) of the thermally insulating arrangement 43 are received, fixed by swaging and brazed, are arranged one after another in the stacking direction of the tubes 2 in the boundary portion sealing surface 518*a*.

In the present embodiment, as shown in FIG. 4, the boundary portion sealing surface 518*a* of the boundary portion 518 of the core plate 51 extends in the corresponding common plane, in which the tube connecting surfaces 511*a* of the tube connecting portions 511 and the secondary sections 514*a*2 of the outer peripheral sealing surface 514*a* extend. The corresponding common plane, in which the boundary portion sealing surface 518*a*, the tube connecting surfaces 511*a* and the secondary sections 514*a*2 extend, is generally parallel to a plane of the primary sections 514*a*1 and is spaced from the plane of the primary sections 514*a*1 in a direction, which is perpendicular to the stacking direction of the tubes 2 and is perpendicular to the plane of the primary sections 514*a*1, away from the center of the core 4 (the longitudinal center of the tubes 2), i.e., away from the outside of the header tank 5. Furthermore, as shown in FIG. 6, partition sealing portions 532 of the packing 53, which will be described later, are installed on the boundary portion sealing surface 518*a*. The boundary portion sealing surface 518*a* can clamp and compress the partition sealing portions 532 of the packing 53 in cooperation with an end of the first partition wall 524*a* and an end of the second partition wall 524*b* provided in the tank main body 52.

Next, the packing 53 will be described in detail with reference to FIG. 5. The packing 53 includes a loop portion 531 and the partition sealing portions 532, which are formed integrally. The loop portion 531 is configured into a loop to correspond with the outer peripheral sealing surface 514*a* of the core plate 51. Each of the partition sealing portions 532 seals between the boundary portion sealing surface 518*a* of the core plate 51 and the corresponding partition wall 524*a*, 524*b*. Furthermore, the loop portion 531 of the packing 53 includes two packing primary sections 531*a*, two packing secondary sections 531*b* and four packing transition sections 531*c*, which are formed to correspond with the two primary sections 514*a*1, the two secondary sections 514*a*2 and the four transition sections 514*a*3, respectively, in terms of the location and the height. The partition sealing portions 532 include a first partition sealing portion 532*a* and a second partition sealing portion 532*b*, which contact the first partition wall 524*a* and the second partition wall 524*b*, respectively, of the tank main body 52. The first and second partition sealing portions 532*a*, 532*b* are connected to the packing secondary sections 531*b* at the same level, i.e., the same height (in the same plane). The packing 53, which is configured in the above described manner, is placed on the outer peripheral sealing surface 514*a* and the boundary portion sealing surface 518*a* of the core plate 51, as shown in FIG. 6.

Next, the tank main body 52 will be described with reference to FIG. 7. In the present embodiment, an upper portion of the tank main body 52 is curved into an arcuate form, and the tank main body 52 is elongated in the stacking direction of the tubes 2. The flange portion 521 is formed to extend all around an opening end of the tank main body 52. A shape of the flange portion 521 of the tank main body 52 corresponds to a shape of the outer peripheral sealing surface 514*a* of the core plate 51. Therefore, when the tank main body 52 is viewed in FIG. 1 (i.e., viewed from a front side of the heat exchanger), the trapezoidal recess is formed about a third main body portion 5203 of the tank main body 52, which will be described later.

The tank main body 52 includes a first main body portion 5201, a second main body portion 5202 and the third main body portion 5203, which form the first recess 5211, the second recess 5212 and the intermediate recess 5213, respectively, therein. The first recess 5211, the second recess 5212 and the intermediate recess 5213 are closed with the core plate 51 to form the first tank chamber 501, the second tank chamber 502 and the intermediate chamber 503, respectively, of the header tank 5.

The first partition wall 524*a* is formed between the first recess 5211 and the intermediate recess 5213 to separate, i.e., partition therebetween, and the second partition wall 524*b* is formed between the second recess 5212 and the intermediate recess 5213 to separate, i.e., partition therebetween. In the present embodiment, the height of the third main body portion 5023 is lower than the first main body portion 5201 and the second main body portion 5202. Therefore, each of the first partition wall 524*a* and the second partition wall 524*b* has an outwardly exposed portion besides a facing portion, which faces the intermediate recess 5213. Furthermore, the third main body portion 5203 includes two reinforcing ribs 525, which connect between the first main body portion 5201 and the second main body portion 5202.

A flange sealing surface 522 is formed in the flange portion 521 of the tank main body 52. The flange sealing surface 522 contacts the loop portion 531 of the packing 53 to clamp and compress the packing 53 by a predetermined compression amount in cooperation with the outer peripheral sealing surface 514*a* of the core plate 51. Therefore, the flange sealing surface 522 includes two flange primary sections 522*a*, two flange secondary sections 522*b* and four flange transition sections 522*c* to correspond with the two primary sections 514*a*1, the two secondary sections 514*a*2 and the four transition sections 514*a*3, respectively.

A protruding portion 523, which protrudes in an arcuate form (a semicylindrical form) toward the loop portion 531 of the packing 53, is formed in the flange sealing surface 522. The protruding portion 523 is provided to reduce the force, which is required to compress and deform the packing 53 by a predetermined amount, and to implement the appropriate compression ratio of the packing 53.

The protruding portion 523, which protrudes in the arcuate form (the semicylindrical form) toward the partition sealing portion 532*a*, 532*b*, is also formed in the end of the first partition wall 524*a* and the end of the second partition wall 524*b*.

As discussed above, in the header tank 5 of the heat exchanger of the present embodiment, the flange primary sections 522*a*, the flange secondary sections 522*b* and the flange transition sections 522*c* of the tank main body 52 compress the packing primary sections 531*a*, the packing secondary sections 531*b* and the packing transition sections 531*c* of the packing 53 in corporation with the primary sections 514*e*1, the secondary sections 514*a*2 and the transition sections 514*a*3 of the outer peripheral sealing surface 514*a* of the core plate 51. Furthermore, the end surface of the first partition wall 524*a* and the end surface of the second partition wall 524*b* of the tank main body 52 compress the first partition sealing portion 532*a* and the second partition sealing portion 532*b* of the packing 53 in corporation with the boundary portion sealing surface 518*a* of the core plate 51. Thereby, the gap between the tank main body 52 and the core plate 51 is sealed by the packing 53.

At this time, the primary sections 514*a*1 and the secondary sections 514*a*2 of the outer peripheral sealing surface 514*a* of the core plate 51 and the boundary portion sealing surface 518*a* extend in the horizontal direction in FIG. 1. Furthermore, although each transition section 514*a*3 is tilted relative to the plane of the adjacent primary section 514*a*1 and the plane of the adjacent secondary section 514*a*2, a tilt angle of the transition section 514*a*3 is moderate, i.e., shallow. Therefore, the forces, which act on the packing 53, are mostly forces, each of which has a generally vertical component. Thus, the compression of the packing 53 can be reliably implemented.

Furthermore, in the present embodiment, the tube connecting surfaces 511*a* and the boundary portion sealing surface 518*a* of the core plate 51 are located in the corresponding common plane. Therefore, irregular tubes, which have the long projecting length toward the inside of the header tank 5, do not exist. As a result, the fixation process of each tube 2 in the corresponding tube receiving hole 517 by the swaging can be reliably performed. Also, the irregular tubes, which have the short expositing length into the air at the core 4, do not exist.

Second Embodiment

Figure 8:
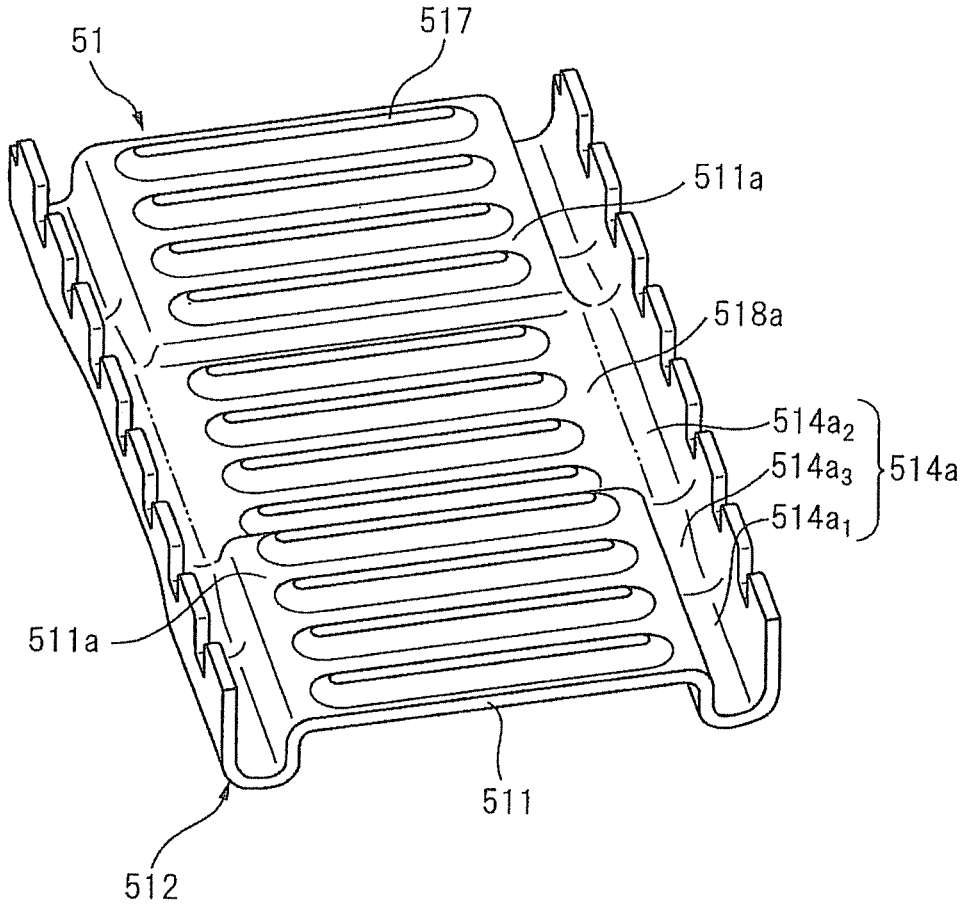
FIG. 8 is a partial enlarged perspective view showing a main feature of a core plate of a header tank of a heat exchanger according to a second embodiment of the present disclosure.
Figure 9:
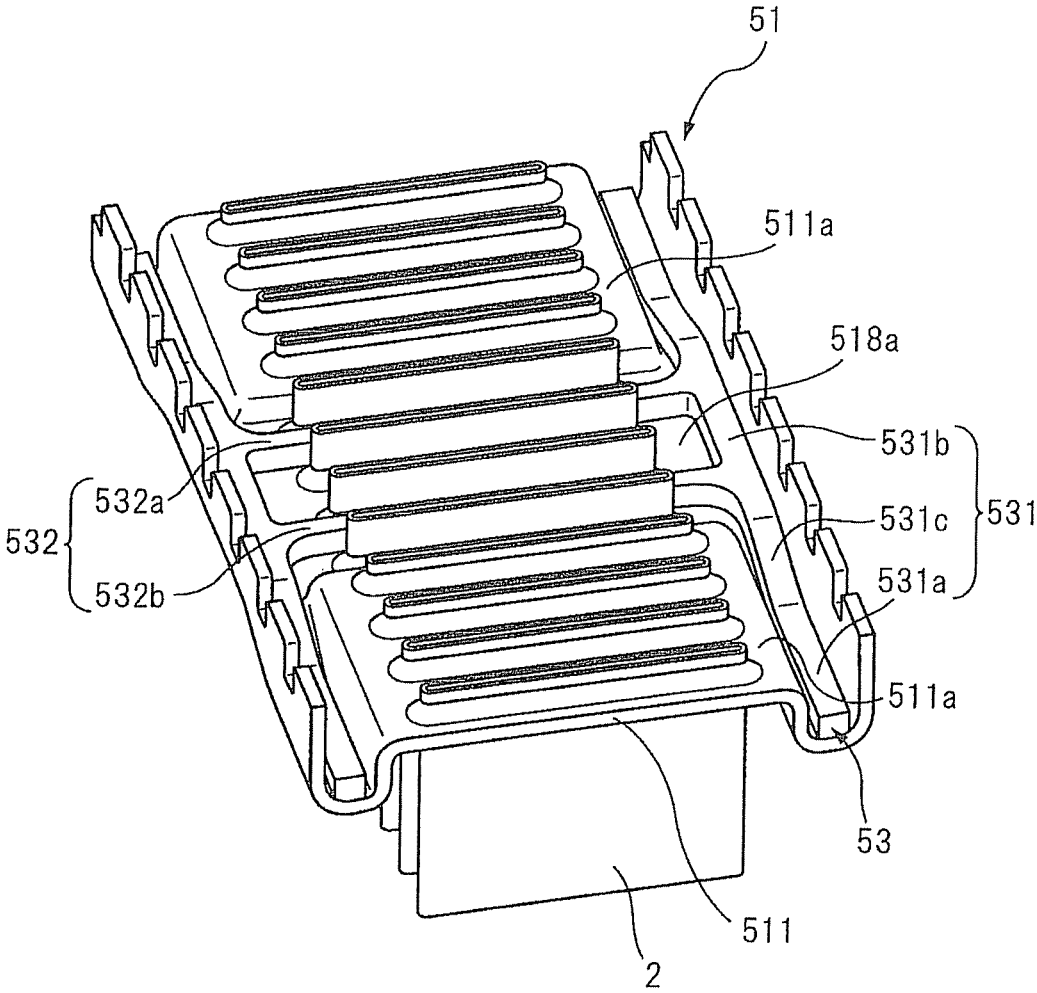
FIG. 9 is a partial enlarged perspective view showing the main feature of the core plate, to which the packing and tubes are installed according to the second embodiment.

Next, a second embodiment of the present disclosure will be described with reference to FIGS. 8 and 9. Here, FIG. 8 is a partial enlarged perspective view showing a main feature of the core plate 51 of the header tank 5 of the heat exchanger of the second embodiment. FIG. 9 is a partial enlarged perspective view showing the main feature of the core plate 51, to which the packing 53 and the tubes 2 are installed according to the second embodiment.

As shown in FIGS. 8 and 9, the heat exchanger of the second embodiment is similar to that of the first embodiment except that the boundary portion sealing surface 518*a* of the core plate 51 is displaced from the tube connecting surfaces 511*a* on the side where the outside of the header tank 5 is located, i.e., on the lower side of the header tank 5 (the side where the other header tank 5 is located, i.e., where the center of the core 4 is located) in FIG. 8. Even in this embodiment, similar to the first embodiment, the plane of the boundary portion sealing surface 518*a* is displaced from the plane of the primary sections 514*a*1 in the direction perpendicular to the plane of the primary sections 514*a*1 within a range that does not exceed the plane of the tube connecting surfaces 511*a* on the side where an inside of the header tank 5 is located, i.e., on the side opposite from the outside of the header tank 5, i.e., opposite from the center of the core 4. More specifically, in this embodiment, the plane of the boundary portion sealing surface 518*a* is located between the plane of the primary sections 514*a*1 and the plane of the tube connecting surfaces 511*a* in the direction perpendicular to the plane of the primary sections 514*a*1. Furthermore, similar to the first embodiment, in the second embodiment, the secondary sections 514*a*2 of the outer peripheral sealing surface 514*a* and the boundary portion sealing surface 518*a* of the core plate 51 are connected with each other at the same level, i.e., in the corresponding common plane, and the outer peripheral sealing surface 514*a* includes the primary sections 514*a*1, the secondary sections 514*a*2 and the transition sections 514*a*3. Furthermore, a boundary between each secondary section 514*a*2 of the outer peripheral sealing surface 514*a* and the boundary portion sealing surface 518*a* is indicated by a dot-dot-dash line in FIG. 8 for ease of understanding.

The header tank 5 of the second embodiment is formed in the above described manner, so that the tilt angle of each transition section 514*a*3 relative to the primary and secondary sections 514*a*1, 514*a*2 can be made further moderate, i.e., shallower in comparison to the first embodiment. Therefore, the projecting length of each corresponding tube 2, which projects from the boundary portion sealing surface 518*a* into the inside of the intermediate chamber 503, becomes longer than that of the other tubes 2. However, the projecting length of the above tubes 2, which project from the boundary portion sealing surface 518*a*, is still shorter than that of the previously proposed technique, in which the outer peripheral sealing surface extends in the corresponding plane, and the boundary portion sealing surface and the outer peripheral sealing surface are located in the same level, i.e., in the same single corresponding plane. Therefore, the appropriate sealing performance can be maintained, and the fixing process of each tube 2 in the corresponding tube receiving hole 517 by the swaging can be more reliably performed in comparison to the previously proposed technique.

Now, modifications of the above embodiments will be described.

As discussed above, it is desirable to use at least one tube 2, which does not conduct the fluid, in the thermally insulating arrangement 43 of the core 4. However, the thermally insulating arrangement 43 may be eliminated from the core 4 in a case where a temperature difference between the first radiator arrangement 41 and the second radiator arrangement 42 is small. In such a case, the header tank 5 does not include the intermediate chamber 503, and a single partition wall 524, which divides between the first tank chamber 501 and the second tank chamber 502, the boundary portion sealing surface 518*a* and the partition sealing portion 532 of the packing 53 are arranged between two adjacent tubes of the first radiator arrangement 41 and of the second radiator arrangement 42, which are arranged adjacent to each other.

Furthermore, in the first and second embodiments, the header tank 5 includes the two tank chambers 501, 502, the single intermediate chamber 503 and the single boundary portion 518 of the core plate 51. However, the number of the partition walls may be increased to increase the numbers of the tank chambers, the intermediate chamber(s) and the boundary portion(s). Also, the number of the first radiator arrangement 41 and the second radiator arrangement 42 (i.e., the heat exchanging arrangements) may be increased to three or more, and the number of the thermally insulating arrangement 43 may be increased to two or more depending on the number of the heat exchanging arrangements.

Additional advantages and modifications will readily occur to those skilled in the art. The present disclosure in its broader terms is therefore not limited to the specific details, representative apparatus, and illustrative examples shown and described.

What is claimed is:

1. A heat exchanger comprising:

a core that includes a plurality of tubes, which are configured to conduct fluid; and two header tanks that are placed at two opposed longitudinal ends, respectively, of the plurality of tubes and are communicated with the plurality of tubes, wherein:

each of the two header tanks includes:

a core plate, to which the plurality of tubes is joined;

a tank main body;

at least one partition wall that is joined to the tank main body;

at least two tank chambers that are formed by the core plate, the tank main body and the at least one partition wall; and a seal member;

an inner surface of the core plate includes:

an outer peripheral sealing surface that is configured into a loop and extends along an outer peripheral edge portion of the core plate and clamps the seal member in cooperation with an outer peripheral end portion of the tank main body;

at least two tube connecting surfaces that extend in a corresponding plane and are located on an inner side of the outer peripheral sealing surface where the plurality of tubes is located, wherein each of the at least two tube connecting surfaces has at least one tube receiving hole, through each of which a corresponding one of the plurality of tubes is received; and at least one boundary portion sealing surface that extends in a corresponding plane, wherein each of the at least one boundary portion sealing surface is located between corresponding adjacent two of the at least two tube connecting surfaces to clamp the seal member in corporation with an end of each corresponding one of the at least one partition wall;

the outer peripheral sealing surface includes:

at least one primary section that extends in a corresponding plane;

at least one secondary section that extends in a corresponding plane, wherein the corresponding plane of the at least one secondary section is generally parallel to the corresponding plane of the at least one primary section and is spaced from the corresponding plane of the at least one primary section in a direction perpendicular to the corresponding plane of the at least one primary section; and at least one transition section, each of which connects between a corresponding one of the at least one primary section and a corresponding one of the at least one secondary section and is tilted relative to the corresponding plane of the at least one primary section and the corresponding plane of the at least one secondary section;

the corresponding plane of the at least one primary section is generally parallel to the corresponding plane of the at least two tube connecting surfaces and is placed on a side of the corresponding plane of the at least two tube connecting surfaces where an outside of the header tank is located;

the corresponding plane of the at least one boundary portion sealing surface is displaced from the corresponding plane of the at least one primary section in a direction perpendicular to the corresponding plane of the at least one primary section within a range that does not exceed the corresponding plane of the at least two tube connecting surfaces on a side where an inside of the header tank is located; and the corresponding plane of the at least one secondary section is the same as the corresponding plane of the at least one boundary portion sealing surface.

2. The heat exchanger according to claim 1, wherein the corresponding plane of the at least one boundary portion sealing surface of the core plate is the same as the corresponding plane of the at least two tube connecting surfaces.

3. The heat exchanger according to claim 1, wherein:

the core includes at least two heat exchanging arrangements;

each of the at least two tank chambers is communicated with a corresponding one of the at least two heat exchanging arrangements through at least one of the plurality of tubes.

4. The heat exchanger according to claim 3, wherein:

the core include at least one thermally insulating arrangement, each of which is placed between corresponding two of the at least two heat exchanging arrangements; and each of the at least one thermally insulating arrangement includes at least one of the plurality of tubes, through which fluid does not flow.

5. The heat exchanger according to claim 4, wherein:

the at least two heat exchanging arrangements includes first and second heat exchanging arrangements;

the at least one thermally insulating arrangement of the core is a single thermally insulating arrangement provided in the core;

the at least one partition wall of each of the two header tanks includes first and second partition walls;

the at least two tank chambers of each of the two header tanks includes first and second tank chambers;

each of the two header tanks includes an intermediate chamber that is formed between the first and second tank chambers; and the at least one of the plurality of tubes of the single thermally insulating arrangement is connected to the intermediate chamber.

* * * * *